US006302285B1

(12) United States Patent
Fulle

(10) Patent No.: US 6,302,285 B1
(45) Date of Patent: Oct. 16, 2001

(54) MERCHANDISE DISPLAY WITH INTERLOCKING PANELS

(75) Inventor: Michael David Fulle, Schaumburg, IL (US)

(73) Assignee: United Packaging Company, Schaumburg, IL (US)

( * ) Notice: Subject to any disclaimer, the term of this patent is extended or adjusted under 35 U.S.C. 154(b) by 0 days.

(21) Appl. No.: 09/669,433

(22) Filed: Sep. 25, 2000

(51) Int. Cl.[7] ..... A47F 5/00
(52) U.S. Cl. ..... 211/189; 211/131.1; 211/163
(58) Field of Search ..... 211/163, 59.1, 211/57.1, 189, 131.1

(56) References Cited

U.S. PATENT DOCUMENTS

| | | | |
|---|---|---|---|
| 1,393,050 | 10/1921 | Talley et al. . | |
| 3,557,422 | 1/1971 | Pfaff . | |
| 3,756,421 | 9/1973 | Wilkins | 211/163 |
| 3,931,894 | 1/1976 | Murphy | 211/163 X |
| 4,586,619 | 5/1986 | Eckert | 211/189 |
| 4,673,090 | 6/1987 | Crosslen . | |
| 4,909,011 | 3/1990 | Freeman et al. . | |
| 5,078,283 | 1/1992 | Wilson | 211/189 X |
| 5,088,678 | 2/1992 | Bitan . | |
| 5,096,073 | 3/1992 | O'Brien | 211/163 |
| 6,094,881 | 8/2000 | Lockwood . | |

*Primary Examiner*—Robert W. Gibson, Jr.
(74) *Attorney, Agent, or Firm*—Olson & Hierl, Ltd.

(57) ABSTRACT

A merchandise display has a plurality of elongated panels joined together to form a column that is polygonal, preferably a pentagon, in cross section. Each panel has a male extension at one side and a female extension on the opposite side. The male extension on one panel cooperates and coacts with the female extension on an adjacent panel. More particularly, the male extension comprises an offset portion with a latch portion at the end. The female extension comprises an offset portion having a latch portion at the end and a projecting portion extending from the panel at a predetermined angle. The projecting portion is spaced from the end of the latch portion so as to define a channel. The male extension of one panel is constructed and arranged to be received in lengthwise sliding relationship in the channel to form the column. The shape and size of the male extension are complementary to the shape and size of the channel. The exterior surfaces of the elongated panels are flush with one another when the adjacent panels are connected.

11 Claims, 2 Drawing Sheets

MERCHANDISE DISPLAY WITH INTERLOCKING PANELS

BACKGROUND OF THE INVENTION

1. Field of the Invention

This invention pertains to a merchandise display with interlocking panels, and more particularly, to a merchandise display that can be shipped easily and compactly in flat panels and then field assembled into a rigid display.

2. Brief Description of the Prior Art

In the past merchandise displays were often assembled in a manufacturing facility and then shipped in an assembled state to a place of use, for example, a retail store. The display might include a base, and side walls with holes or openings therein for receiving hooks from which merchandise, such as packages of screws, bolts, candy, etc. might be hung. The merchandise is displayed to the consumer and can be easily removed from the hook by the consumer who wished to purchase the goods contained in the displayed packages. The handling and shipment of bulky assembled displays was difficult and costly.

SUMMARY OF THE INVENTION

The present invention provides a merchandise display that overcomes the disadvantages of prior merchandise displays by providing a plurality of panels that interconnect in a unique fashion to provide a stable and rigid display that can be easily shipped and field assembled on site with a minimum of time and effort.

An object of the present invention is to provide a merchandise display formed of plurality of interconnected panels that can be shipped flat and then easily field assembled.

Another object of the present invention is to provide a merchandise display formed of a plurality of interconnected panels utilizing joints comprised of complementary male and female extensions that interconnect in sliding relationship to form a rigid columnar display.

Other objects and advantages of the present invention will be made more apparent in the description which follows.

The present invention provides a merchandise display comprising a plurality of elongated panels joined together to form a column defining a polygon in cross section. Each panel has a male extension at one side and a female extension on the opposite side, with the male extension of one panel coacting with the female extension of an adjacent panel. The male extension comprises an offset portion having a latch portion at the end. The female extension comprises an offset portion having a latch portion at the end and a projecting portion extending from the panel at a predetermined angle, with the projecting portion being spaced from the end of the latch portion so as to define a channel. The male extension of each panel is received in sliding relationship in said channel in an adjacent panel to form said column.

BRIEF DESCRIPTION OF THE DRAWING

There is shown in the attached drawing a presently preferred embodiment of the present invention wherein like numerals in the various views refer to like elements and wherein.

DETAILED DESCRIPTION OF THE PRESENT INVENTION

Figure 1:
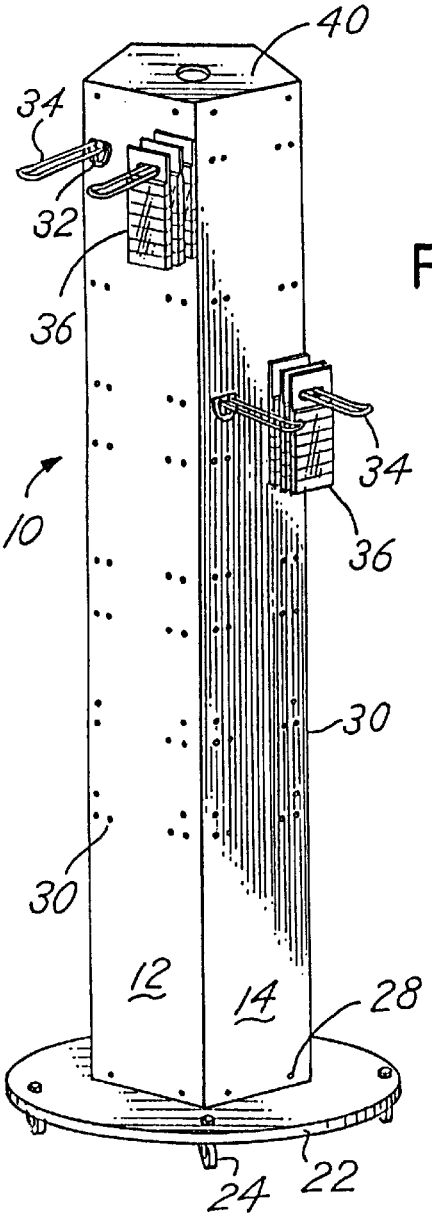
FIG. 1 is a perspective view of a merchandise display embodying the interlocking panels of the present invention.
Figure 2:
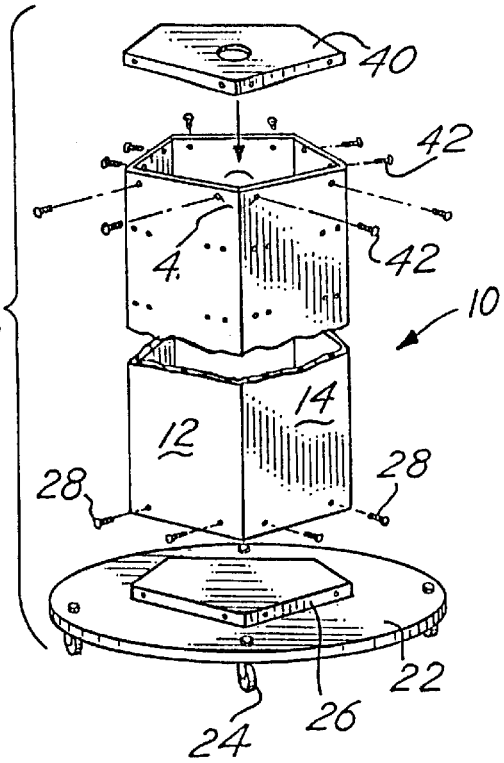
FIG. 2 is a perspective view of the merchandise display, partially exploded, to better illustrate the components thereof.
Figure 3:
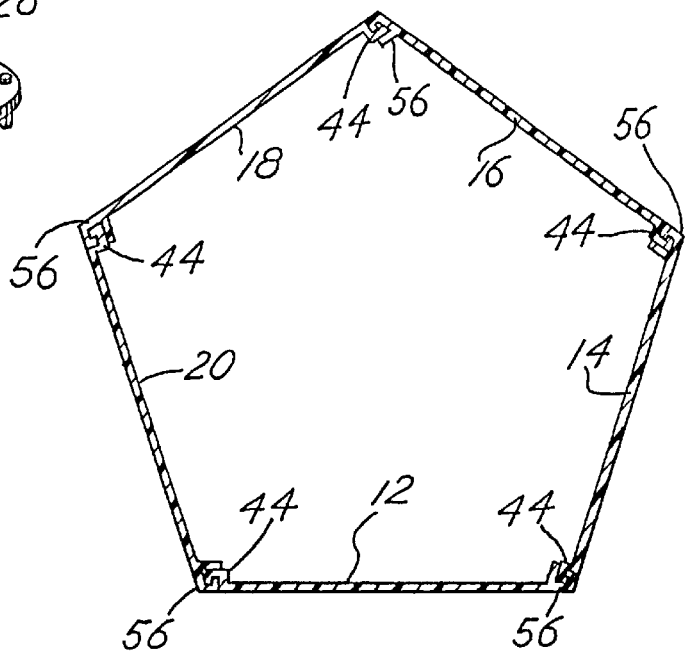
FIG. 3 is a plan view of the merchandise display showing a plurality of interconnected panels that define a pentagon shape.

There is shown in FIGS. 1,2, and 3 a merchandise display 10 embodying the interlocking panels 12, 14, 16, 18, and 20 of the present invention. The assembled panels 12, 14, 16, 18, and 20 are adapted to be supported on a base 22, that is preferably round as shown. The base 22 may be fabricated from wood or plastic or another material as desired, though presently, wood is preferred. The base 22 is provided with suitable rollers or casters 24 to enable easy movement of the assembled merchandise display 10 on the floor even if the merchandise display 10 is loaded with merchandise, which could weigh several hundred pounds. The base 22 is provide with a raised center portion 26 (FIG. 2) that is shaped to conform to the inner dimension of the column formed by the interlocked panels 12, 14, 16, 18, and 20. Preferably, the lower end of the panels 12, 14, 16, 18, and 20 are secured to the sides of the raised portion by suitable fastening means, as for example, screws 28.

As seen in FIGS. 1 and 2 the panels 12 and 14 are provided with a plurality of spaced apart holes or openings 30 for receiving hooks 32 and supports 34. An exemplary bag or package 36 is shown on the support 34. It will be understand that each support 34 is adapted to support a plurality of bags or packages 36 and that there may be a hook 32 assembled in each pair of adjacent holes or openings 30.

A top 40 is adapted to close the open upper end of the column formed by the panels 12, 14, 16, 18, and 20. The top 40 is shaped to conform to the interior shape of the column and to be secured in place by suitable fastening means, for example, screws 42.

Figure 4:
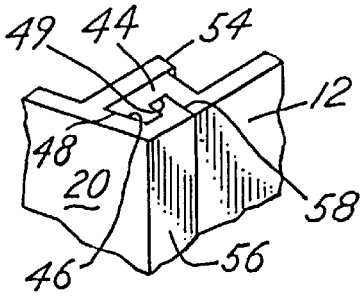
FIG. 4 is a detail perspective view of a joint assembly.
Figure 5:
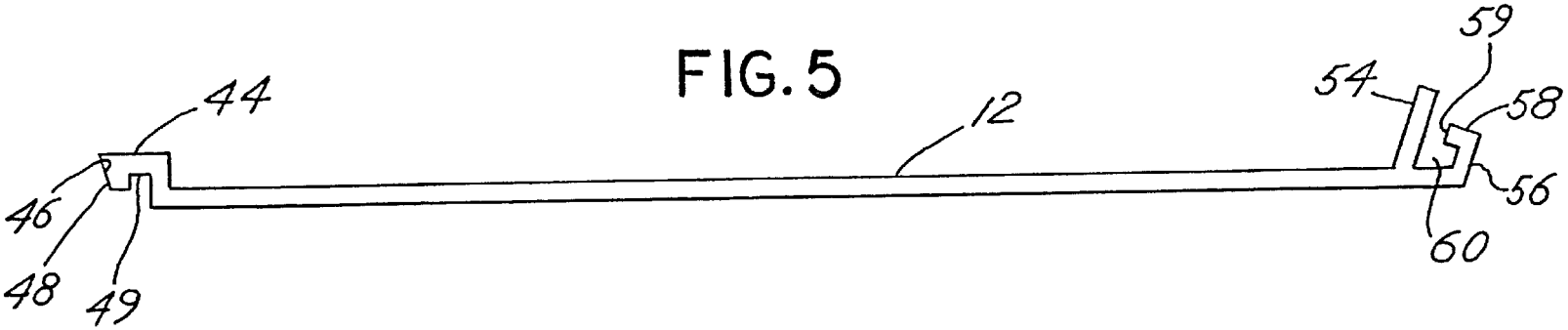
FIG. 5 is an enlarged end view of a panel, which better shows the ends thereof.

Turning to FIGS. 3, 4, and 5 it will be observed that the panels forming the column are interconnected in a unique sliding fashion. The panels each have a male side portion and a female side portion that interconnect with the opposite member of an adjacent panel. The panel 12 will be described and it will be understood that the explanation applies to each of the other panels. The male side portion of the panel 12 includes an offset portion 44 having a latch portion 46 at the end thereof. The surface 48 of the latch portion 46 is formed at a predetermined angle, as will be more fully explained hereinafter. The offset portion 44 extends at generally a right angle from the panel 12 and has a recess 49 defined therein.

The opposite side of the panel 12 is provided with an extension or projecting portion 54 that extends at a predetermined angle from the panel 12. At the side of the panel 12 is an offset portion 56 having a latch portion 58 formed thereon. The surface 59 of Patch portion 58 is spaced from the extension portion 54. The extension portion 54 and the offset portion 56 cooperate to define a channel 60 for receiving the offset portion 44 of the male extension of an adjacent panel. It will be observed that the male extension is complementary in configuration to the female extension and fits snugly therein.

With reference to FIGS. 3 and 4, it is noted that the outer surfaces of the panels join in a smooth, flush fashion. The interlocking joints smoothly connect one to the other by virtue of the dimensioning of the offset portions at the sides of each panel. The offset portion 44 and the offset portion 56 are formed integrally with the panel 12. In the embodiment of the invention illustrated, wherein the display 10 is a pentagon in cross section, the angle of the exterior surface 48 with respect to the plane of the panel 12 is about 72°. The angle of the extension portion with respect to the plane of the panel 12 is about 72°. The offset portion 56 extends generally parallel to the extension portion 54 and the surface 59 of the latch portion 58 extends generally parallel to the extension portion 54. The surface 59 is spaced from the extension portion 54 slightly more than the thickness of the offset portion 44 received therein when the adjacent panel members are joined.

The panels 12, 14, 16, 18 and 20 may be extruded or otherwise formed from plastic, such as polystyrene and may be colored or clear (transparent) as desired. Thus the panels when assembled may have various uses. For example, a column of panels formed of clear plastic might be used as a container for candy or like merchandise. The column could form the base or pedestal for a merchandise display or merchandise dispenser. Alternately, the column could be supported on a base, as shown in FIGS. 1 and 2 to support merchandise.

Figure 6:
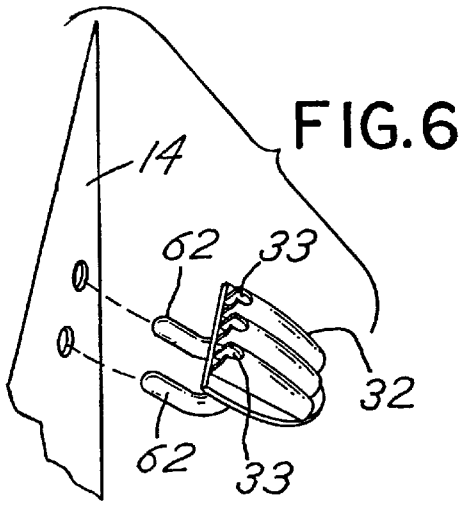
FIG. 6 is a perspective view of a hook being assembled to a panel.
Figure 7:
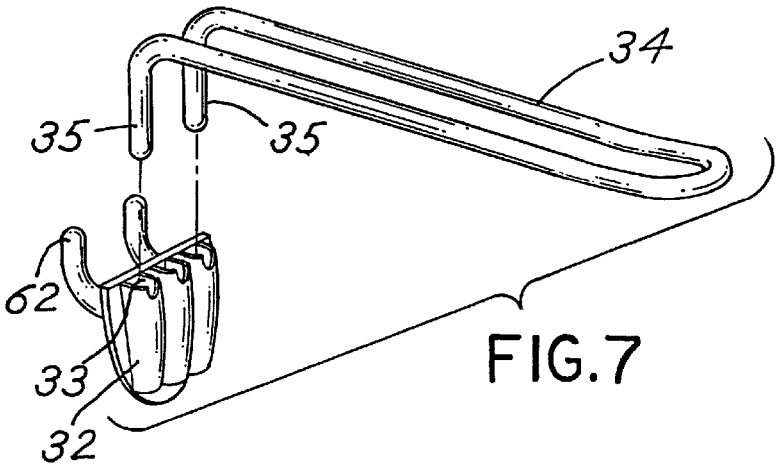
FIG. 7 is a perspective view illustrating the connection of a support to a hook.

In FIGS. 6 and 7, there is better shown a preferred method of supporting merchandise packages on the merchandise display 10. Hook 32 having prongs 62 is connected to the panel 14 by inserting the prongs 62 into a pair of adjacent openings 30 in the panel 14. The downwardly bent ends 35 of the support 34 are then inserted into the openings 33 in the hook 32 for retaining the support 34 in position. The hooks 32 can be suitably formed from metal or plastic, as desired. The supports 34 are preferably formed from metal rod stock bent to desired shape.

While I have shown and described a presently preferred embodiment of the present invention, it will be understood that the invention may be otherwise embodied within the scope of the appended claims.

What is claimed is:

1. A display comprising a plurality of elongated panels joined together to form a column defining a polygon in cross section, each panel having a male extension at one side and a female extension on the opposite side, the male extension of one panel coacting with the female extension of an adjacent panel, the male extension comprising an offset portion having a latch portion at the end, the female extension comprising an offset portion having a latch portion at the end and a projecting portion extending from the panel at a predetermined angle, said projecting portion being spaced from the end of the latch portion so as to define a channel, the male extension of an adjacent panel being received in lengthwise sliding relationship in said channel to form said column.

2. A display as in claim 1, wherein each projecting portion extends at an angle of about 72° from the panel from which it projects, and said column defines a pentagon in cross section.

3. A display as in claim 2, wherein the outer surfaces of the adjacent panels join in a smooth, flush fashion.

4. A display as in claim 1, wherein the display includes a base for supporting the joined together elongated panels.

5. A display as in claim 4, wherein wheels are connected to the base to permit movement of the base on a support surface.

6. A display as in claim 1, wherein the elongated panels are provided with a plurality of spaced openings, and hook means are secured in the spaced openings for supporting merchandise to be displayed.

7. A display as in claim 6, wherein the hook means comprise a hook constructed and arranged to be supported in at least one opening in an elongated panel and a support detachably connected to the hook.

8. A display as in claim 1, wherein the elongated panels are formed from plastic.

9. A display as in claim 1, wherein the shape of the male extension is complementary to the shape of the channel.

10. A display as in claim 9, wherein the exterior surface of an elongated panel is flush with the extension surfaces of the adjacent connected panels.

11. A display as in claim 9, wherein the latch portion on the male extension has an exterior surface disposed at a predetermined inwardly extending angle, and the latch portion on the female extension has a surface facing the projecting portion and spaced approximately the thickness of the latter portion on the male extension therefrom, the latch portion on the female extension extending in generally parallel relationship with the projecting portion, the male extension of one panel being received in sliding engagement with the channel in the female extension of an adjacent panel.

* * * * *